US006655255B2

(12) United States Patent
May

(10) Patent No.: US 6,655,255 B2
(45) Date of Patent: Dec. 2, 2003

(54) SWASHPLATE ARRANGEMENT FOR AN AXIAL PISTON PUMP

(75) Inventor: Michael P. May, Plainfield, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/901,999

(22) Filed: Jul. 10, 2001

(65) Prior Publication Data

US 2003/0010199 A1 Jan. 16, 2003

(51) Int. Cl.[7] ..... F01B 13/04
(52) U.S. Cl. ..... 92/12.2; 91/506
(58) Field of Search ..... 92/12.2; 91/506; 417/222.1; 74/839

(56) References Cited

U.S. PATENT DOCUMENTS 3,384,028 A 5/1968 Thoma
3,803,987 A 4/1974 Knapp
4,584,926 A 4/1986 Beck, Jr. et al.
4,825,753 A 5/1989 Inoue et al.
4,886,423 A 12/1989 Iwanami et al.
4,896,585 A 1/1990 Forster
4,932,373 A 6/1990 Carson
5,380,167 A 1/1995 Burkett et al.
5,390,584 A 2/1995 Fritz et al.
5,649,468 A 7/1997 Tsurumi et al.
5,927,176 A 7/1999 Stolzer

*Primary Examiner*—Edward K. Look
*Assistant Examiner*—Michael Leslie
(74) *Attorney, Agent, or Firm*—J. W. Burrows; Steven N. Hanley

(57) ABSTRACT

A variable displacement axial piston pump is typically used to receive fluid from a tank and supply pressurized fluid through a control valve to move an actuator. The present variable displacement axial piston pump has a swashplate arrangement that is capable of being angled in two different directions to control the pressure transitions between the low pressure inlet port passage and the higher pressure outlet port passage as cylinder bores in a barrel of a rotating group rotate through trapped volume regions situated between inlet and outlet port passages of the axial piston pump. Movement of the swashplate arrangement in two different directions provides smooth pressure transitions and increases the operating efficiency of the variable displacement axial piston pump.

20 Claims, 7 Drawing Sheets

SWASHPLATE ARRANGEMENT FOR AN AXIAL PISTON PUMP

TECHNICAL FIELD

This invention relates generally to an axial piston pump and more specifically to a swashplate arrangement for an axial piston pump.

BACKGROUND

Variable displacement axial piston pumps are well known in the art and typically include a barrel having a plurality of piston assemblies slideably disposed in respective bores within the barrel and a swashplate that is in mating contact with the piston assemblies so that the piston assemblies are forced to reciprocate within the bores of the barrel to receive fluid therein and discharge fluid therefrom. The swashplate is secured to the housing of the pump and is selectively pivotable relative to the barrel so that the volume of fluid being discharged therefrom may be controlled. There has been many attempts to control the pressure transition between the point at which all of the fluid has been discharged from the respective bores and the point at which the respective bores are opened to receive more fluid. Likewise, there has been many attempts to control the pressure transition between the point at which the respective bores are full and the point at which respective bores are opended to discharge fluid. In most of these attempts, special slots or holes are provided to controllably interconnect the high pressure side of the pump to the low pressure side and vice-versa to make the pressure transition as smooth as possible. Even with the special slots or holes, energy is wasted during the respective pressure transitions.

Another example of an axial piston pump attempts to provide a new neutral control of the swashplate. In this arrangement, the swashplate assembly has a primary swashplate that is rotated in a well known manner and a thrust plate is permitted to freely pivot in a 360 degree arc relative to the primary swashplate for a small, predefined distance. This permits the pump to rely on its internal swivel forces to move the thrust plate to a non-fluid discharging mode anytime the swashplate is near its zero position. Such an arrangement is set forth in U.S. Pat. No. 4,825,753, issued May 2, 1989 and assigned to Kayaba Industry Co.

The present invention is directed to overcoming one or more of the problems as set forth above.

SUMMARY OF THE INVENTION

In one aspect of the present invention, a variable displacement axial piston pump is adapted for use in a fluid system. The variable displacement axial piston pump includes a housing, a rotating group, and a swashplate arrangement. The housing has a body portion and a head portion with an inlet port passage and an outlet port passage. The rotating group is disposed in the body portion and has an axis of rotation. The rotating group includes a barrel having a plurality of cylinder bores and a plurality of piston assemblies with each of the plurality of piston assemblies having a piston slideably disposed within one of the cylinder bores and a shoe pivotably attached to and extending from the piston. The barrel of the rotating group is in fluid communication with the inlet and outlet port passages of the housing head portion. The swashplate arrangement is disposed in the body portion and is pivotable in a first arcuate direction relative to the axis of rotation of the barrel and pivotable in a second arcuate direction in response to various system parameters.

In another aspect of the subject invention, a method of controlling pressure transitions is provided within a variable displacement axial piston pump between its inlet passage and its outlet passage. The method includes providing a rotating group having an axis of rotation, providing a swashplate arrangement pivotable in a first arcuate direction relative to the axis of rotation of the rotating group and pivotable in a second arcuate direction in response to various system parameters.

DETAILED DESCRIPTION

Figure 1:
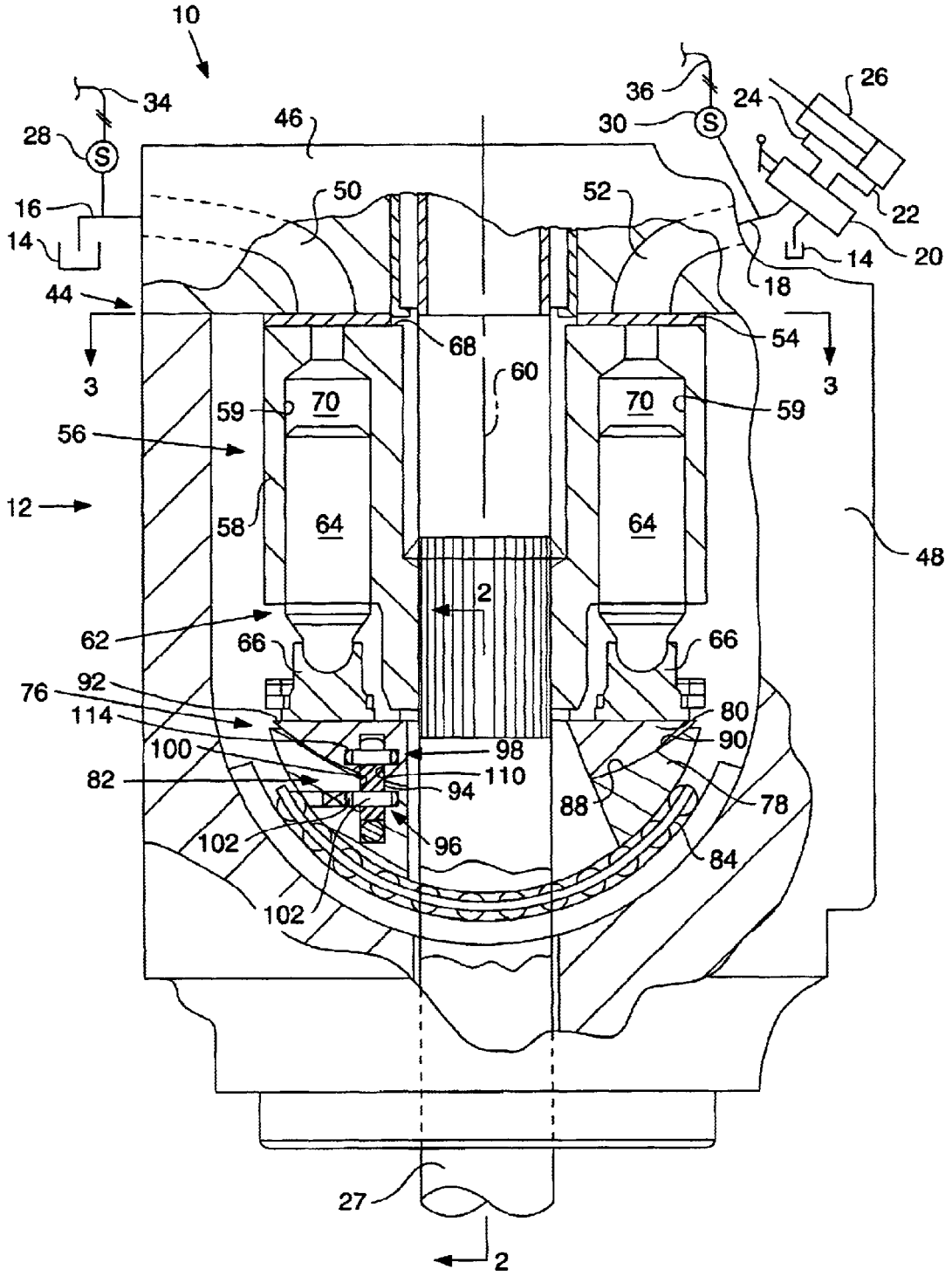
FIG. 1 is a partial schematic and partial diagrammatic representation of a fluid pump and a fluid system incorporating an embodiment of the present invention.
Figure 2:
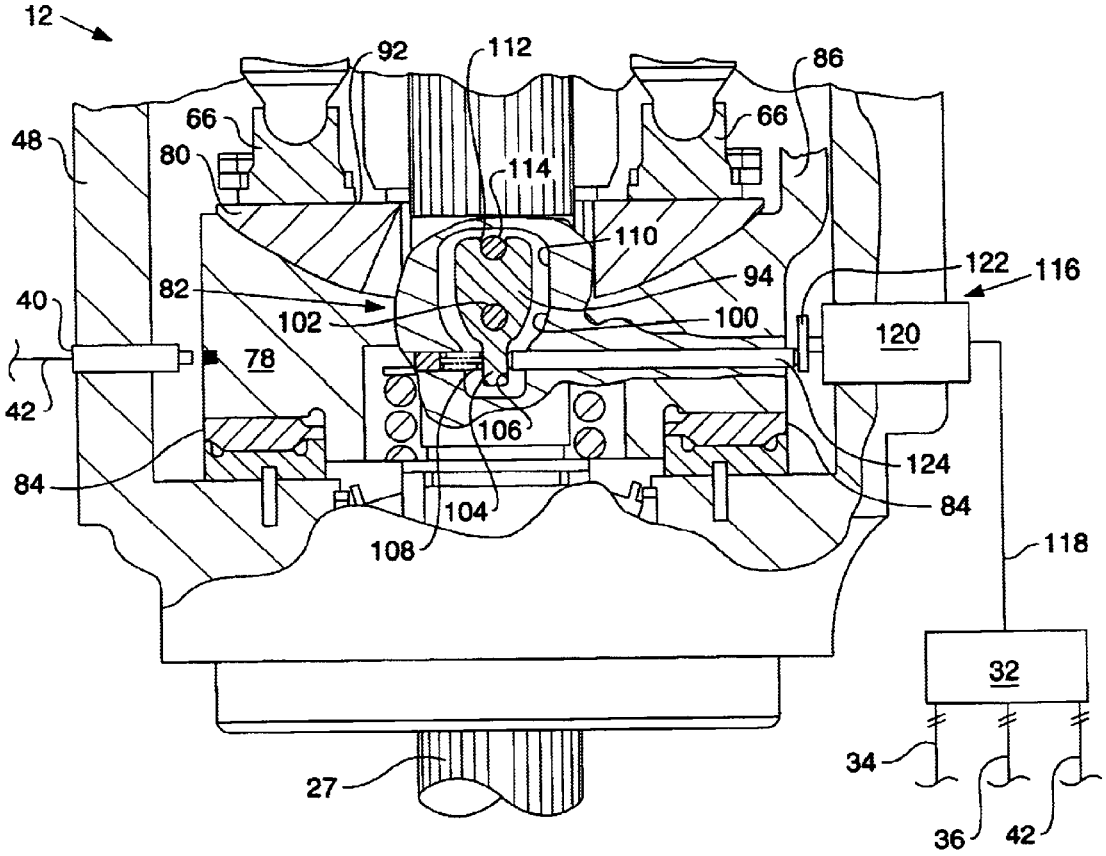
FIG. 2 is a partial schematic and partial diagrammatic representation of a section 2—2 taken from FIG. 1.
Figure 3:
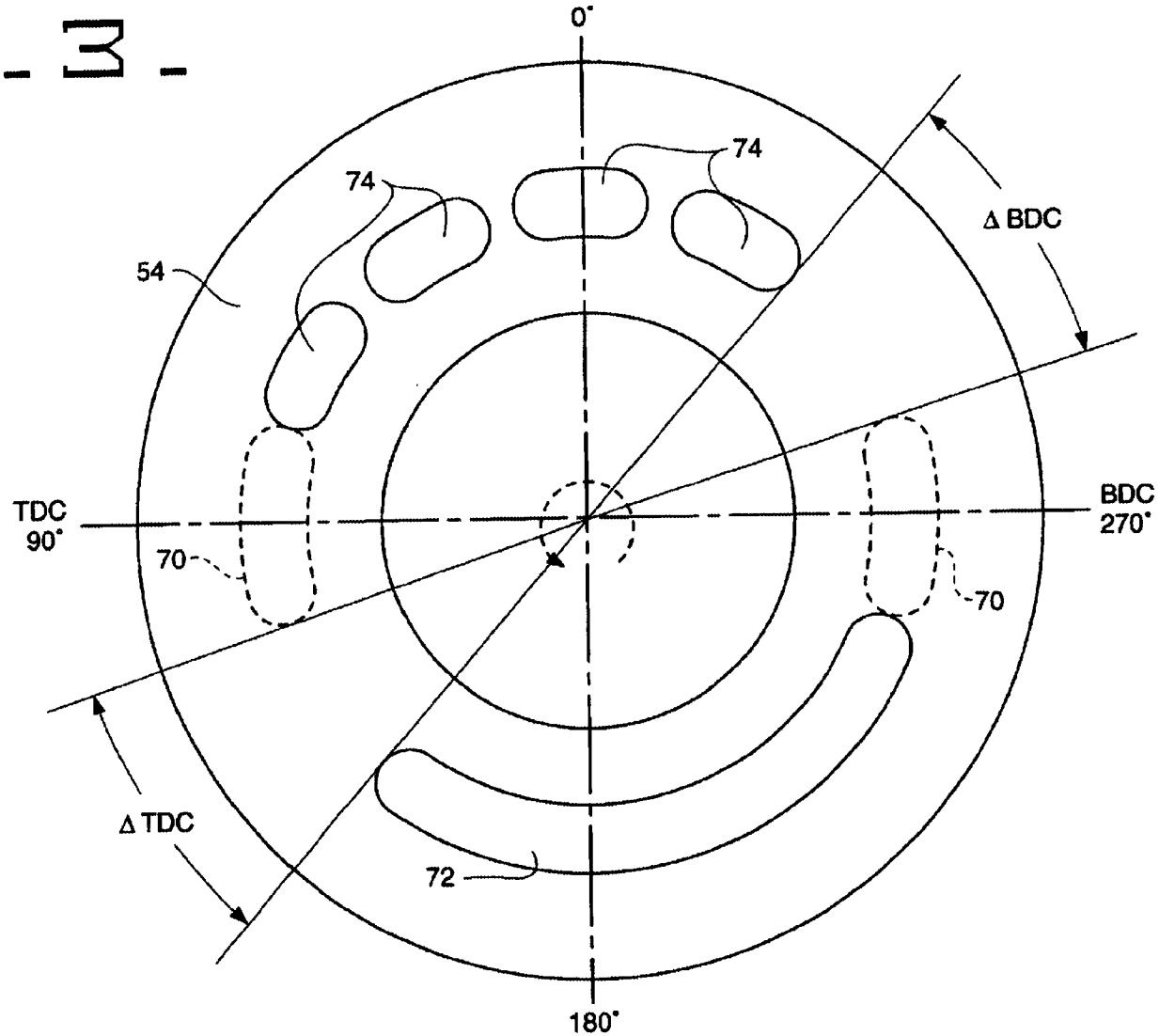
FIG. 3 is a diagrammatic representation of the porting of the fluid within the head of the pump or the port plate taken along the line 3—3 from FIG. 1.

Referring now to the drawings and more particularly to FIGS. 1–3, a fluid system 10 is illustrated and includes a variable displacement axial piston pump 12 that receives fluid from a tank 14 via a conduit 16 and delivers pressurized fluid via a supply conduit 18 to a fluid control valve 20 and selectively through work conduits 22, 24 to a fluid actuator 26. In the subject arrangement, the variable displacement axial piston pump 12 is a unidirectional pump that rotates in a counterclockwise direction as driven by a power input shaft 27.

The fluid system 10 also includes first and second pressure sensors 28, 30 respectively connected to the tank conduit 16 and the supply conduit 18. The pressure sensors 28, 30 are operative to sense the pressure in the respective lines and deliver an electrical signal to a controller 32 through electrical lines 34, 36. A position sensor 40 is mounted on the variable displacement axial piston pump 12 and operative to sense the displacement of the pump and deliver a signal representative thereof to the controller 32 via an electrical line 42.

Various other components could be used in the subject fluid system 10 without departing from the essence of the subject invention. For example, several control valves 20 and associated fluid actuators 26 could be used. Likewise, other sensors of various types and styles could be used.

The variable displacement axial piston pump 12 includes a housing 44 having a head portion 46 and a body portion 48.

The head portion 46 defines an inlet port passage 50 that is connected to the conduit 16 and an outlet port passage 52 that is connected to the supply conduit 18. In the subject arrangement, a port plate 54 is disposed between the head portion 46 and the body portion 48. The construction of the porting within the port plate 54 is more clearly illustrated in FIG. 3 and will be discussed more fully below. It is recognized that the porting illustrated in FIG. 3 could be made within the head portion 46 without departing from the essence of the subject invention.

A rotating group 56 is disposed within the body portion 48 and includes a barrel 58 having a plurality of cylinder bores 59 defined therein spaced from one another around an axis of rotation 60 of the barrel 58. Each of the cylinder bores 59 is oriented within the barrel 58 parallel with the axis of rotation 60. A plurality of piston assemblies 62 are operatively associated with the barrel 58 and each one of the plurality of piston assemblies 62 includes a piston 64 slideably disposed in the respective ones of the plurality of cylinder bores 59. Each one of the plurality of piston assemblies 62 also has a shoe 66 pivotably attached to one end of each piston 64 in a conventional manner.

The barrel 58 has an end surface 68 that is in mating, sealing contact with the port plate 54 to provide communication between the cylinder bores 58 and the respective inlet and outlet port passages 50, 52 of the head portion 46. A closed chamber 70 is defined in each cylinder bore 59 of the barrel 58 between the end of the piston 64 and the end surface 68 thereof.

Referring to FIG. 3, the porting between the barrel 58 and inlet and outlet port passages 50, 52 of the head portion 46 is more clearly illustrated. For explanation purposes only, the "270" degree position illustrated in FIG. 3 relates to a position on the right side of the drawing of FIG. 1 and the "0" degree position illustrated in FIG. 3 relates to a position on the right side of the drawing of FIG. 2. An arcuate slot 72 is defined in the port plate 54 and provides communication between the plurality of closed chambers 70 and the inlet port passage 50. A plurality of slots 74 are defined in the port plate 54 circumferentially spaced from the arcuate slot 72 and provides communication between the plurality of closed chambers 70 and the outlet port passage 52. The "0" and the "180" degree positions represent a neutral axis which will be more fully described hereinafter. The "90" degree position, commonly referred to as the Top Dead Center (TDC) position, represents the point at which the respective closed chambers 70 are at their smallest volume for a given displacement of the variable displacement axial piston pump 12. The "270" degree position, commonly referred to as the Bottom Dead Center (BDC) position, represents the point at which the respective closed chambers 70 are at their largest volume for a given displacement. The arcuate distances 'delta' TDC and 'delta' BDC represent the distance that the barrel 58 travels during use in which a trapped volume of fluid within respective closed chambers 70 are being subjected to changing pressures depending on the direction of movement of the respective pistons 64 within their associated cylinder bores 59.

Referring again to FIGS. 1 and 2, a swashplate arrangement 76 is pivotably disposed within the body portion 48. As viewed in FIG. 1, the swashplate arrangement 76 is pivoted in a first arcuate, clockwise direction relative to the axis of rotation 60 of the rotating group 56. The swashplate arrangement 76 of the subject embodiment includes a primary member 78, a secondary member 80, and an actuating mechanism 82. The primary member 78 is mounted within the body portion 48 on a pair of arcuate bearing assemblies 84 in a known manner. An operating lever 86 extends from the primary member 78 and is operative in response to an external command (not shown) to change the angular position of the primary member 78 relative to the axis of rotation of the rotating group 56. The primary member 78 has a concave spherical surface 88 on one side thereof between the pair of bearing assemblies 84.

The secondary member 80 is pivotably disposed on the primary member 78 and has a convex spherical surface 90 on one side thereof that is of a size and shape sufficient to mate with the concave spherical surface 88 of the primary member 78. As viewed in FIG. 2, the secondary member 80 rotates in a counterclockwise direction. The pivot direction of the secondary member 80 is oriented at an angle about the axis of rotation 60 of the rotating group 56 relative to the pivot direction of the primary member 78 and could be in the range of 80 to 100 degrees. In the subject embodiment, the angle is at 90 degrees. A flat surface 92 is disposed on the other side of the secondary member 80 and mates, in a well known sliding relationship, with the respective shoes 66 of the plurality of piston assemblies 62 of the rotating group 56.

In FIG. 2, the actuating mechanism 82 is shown broken out from the sectional view. As can be understood from FIG. 1, the actuating mechanism 82, when viewed in FIG. 2, would be located behind the power input shaft 27. In order to more clearly illustrate the actuating mechanism 82, it is being shown as a broken out portion. The actuating mechanism 82 includes a link 94 having a first portion 96 and a second portion 98. The first portion 96 is disposed in a slot 100 of the primary member 78 and rotated about a pin 102 disposed thereacross. The first portion 96 also includes a lever arm 104 at the end thereof away from the second portion 98. An abutment shoulder 106 is disposed within the slot 100 at the bottom thereof and the lever arm 104 is in operative contact with the abutment shoulder 106. A biasing member 108, such as a spring, is disposed in the slot 100 and is operative to bias the lever arm 104 against the abutment shoulder 106 thus holding the secondary member 80 in its "0" angle position relative to the primary member 78.

The second portion 98 of the link 94 extends into a slot 110 defined within the secondary member 80. A slot 112 is defined at the end of the second portion 98 and a reaction member 114 is disposed across the slot 110 of the secondary member 80 and through the slot 112 of the second portion 98 of the link 94.

A remotely controlled actuating mechanism 116 is mounted on the housing 48 and is connected to the controller 32 via a signal line 118. The actuating mechanism 116 includes an actuator 120 having an output member 122 in continuous operative contact with a force member 124 that is disposed within the primary member 78 and in contact with the lever arm 104 of the link 94 and acts against the bias of the biasing member 108.

Figure 4A:
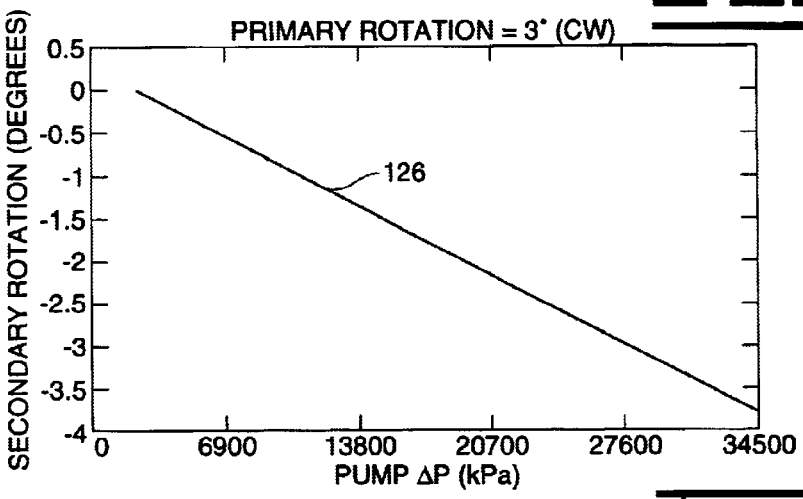
FIGS. 4A–C are plots illustrating the relationship of different differential pressures within the fluid system at a fixed primary swashplate angle relative to a secondary angle of the swashplate.
Figure 4B:
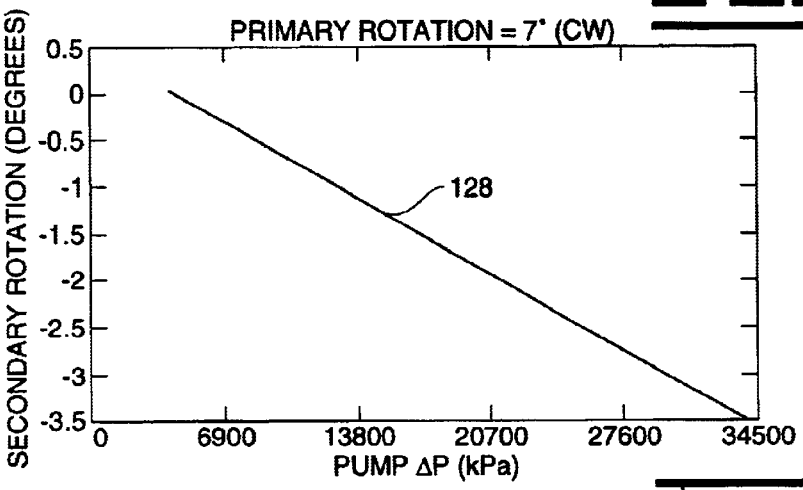
Figure 4C:
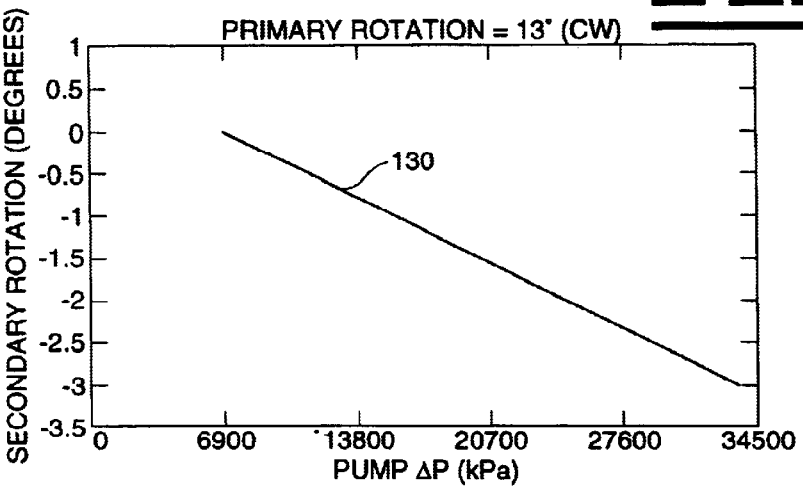

FIGS. 4A–C relates to one representative example, each plot refers to the relationship of the differential pressure between the inlet and outlet port passages 50, 52 and the magnitude of movement needed in the secondary member 80, with the primary angle at a fixed location, to provide a smooth pressure transition between the inlet and outlet port passages 50, 52 as each cylinder bore 59 of the barrel 58 moves through the top and bottom dead center positions (TDC, BDC). The plot line 126 in FIG. 4A illustrates the above noted relationship when the primary member 78 is fixed at 3 degrees. The plot line 128 in FIG. 4B illustrates the same relationship when the primary member 78 is fixed at 7 degrees while the plot line 130 in FIG. 4C illustrates the same relationship when the primary member 78 is fixed at 13 degrees.

Figure 5A:
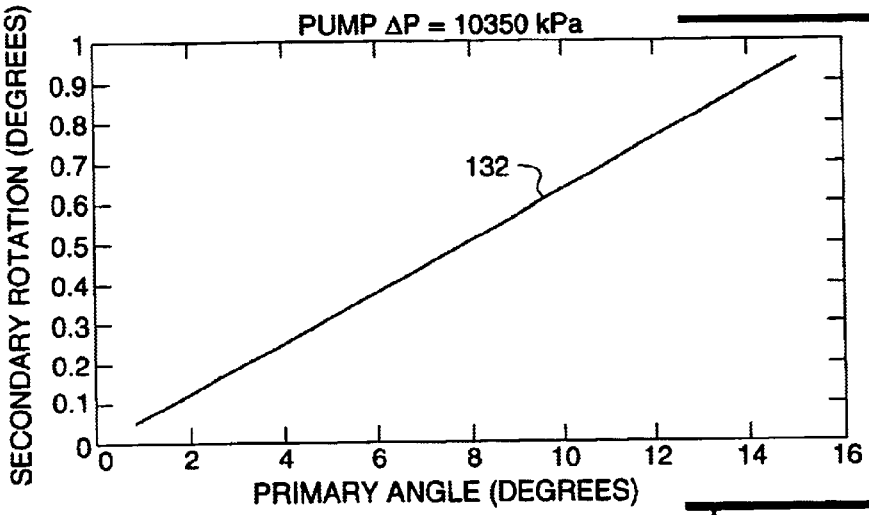
FIGS. 5A–C are plots illustrating the relationship of different primary swashplate angles at a fixed differential pressure within the fluid system relative to a secondary angle of the swashplate.
Figure 5B:
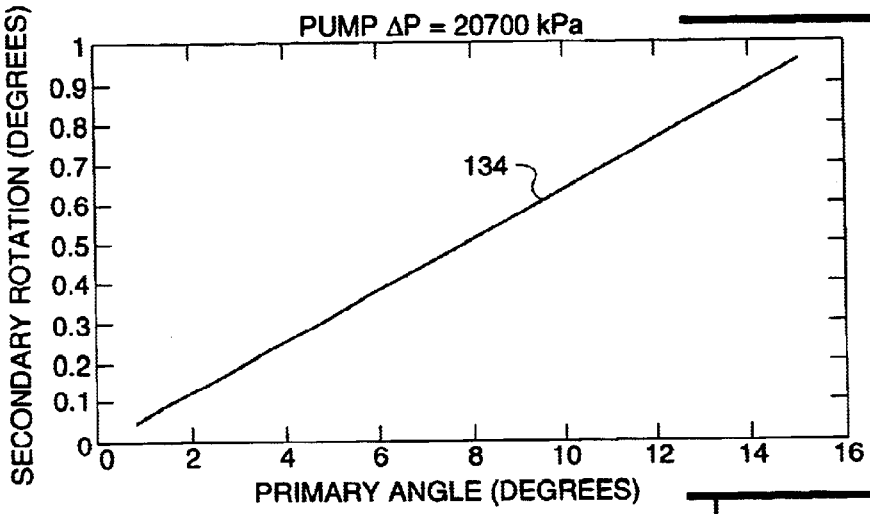
Figure 5C:
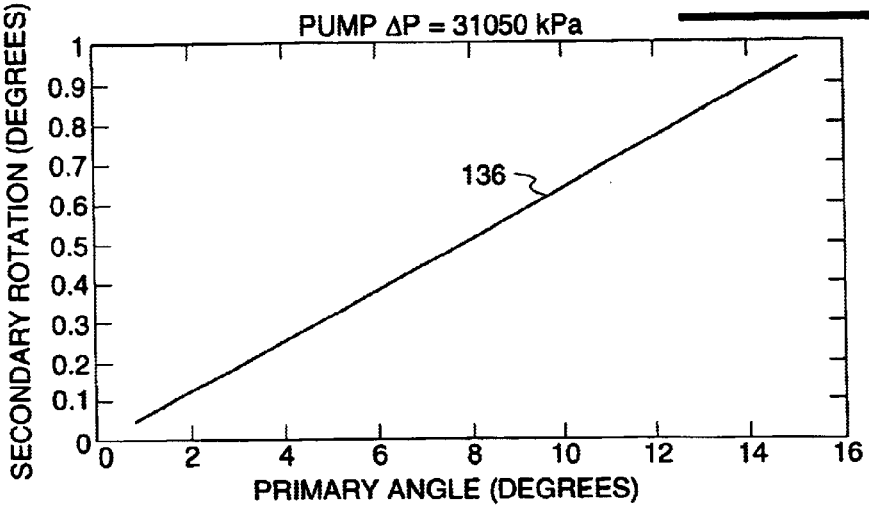

FIGS. 5A–C relates to the same representative working example as that of FIGS. 4A–C. Each plot of FIGS. 5A–C relates to the relationship of the angle of the primary member 78 and the magnitude of movement needed for the angle of the secondary member 80 when the differential pressure between the inlet and outlet port passages 50, 52 is maintained at a fixed level to provide a smooth pressure transition between the inlet and outlet port passages 50, 52 as each cylinder bore 59 of the barrel 58 moves through the top and bottom dead center positions (TDC, BDC). The plot line 132 of FIG. 5A illustrates the above noted relationship when the differential pressure between the inlet and outlet port passages 50, 52 is maintained at 10,350 kPa (approx. 1500 psi). The plot line 134 of FIG. 5B illustrates the same relationship when the differential pressure is maintained at 20,700 kPa (approx. 3000 psi) while the plot line 136 of FIG. 5C illustrates the same relationship when the differential pressure is maintained at 31,050 (approx. 4500 psi).

Figure 6A:
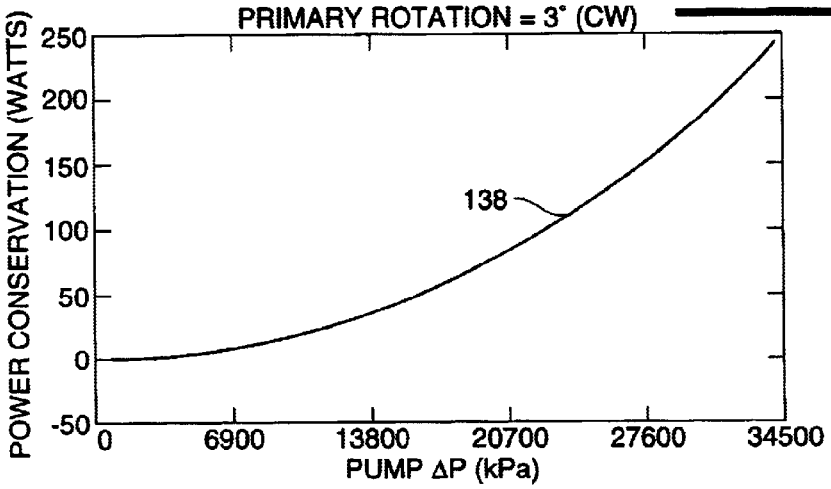
FIGS. 6A–C are plots illustrating the power savings of the subject invention with the primary angle of the swashplate being held at various fixed positions.
Figure 6B:
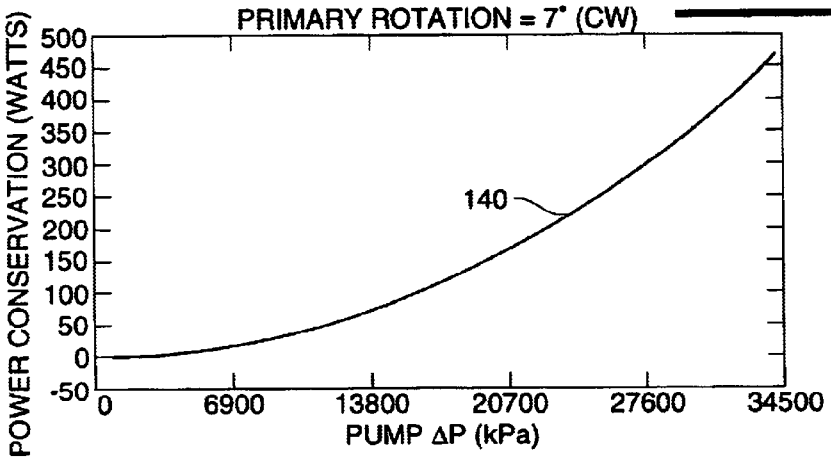
Figure 6C:
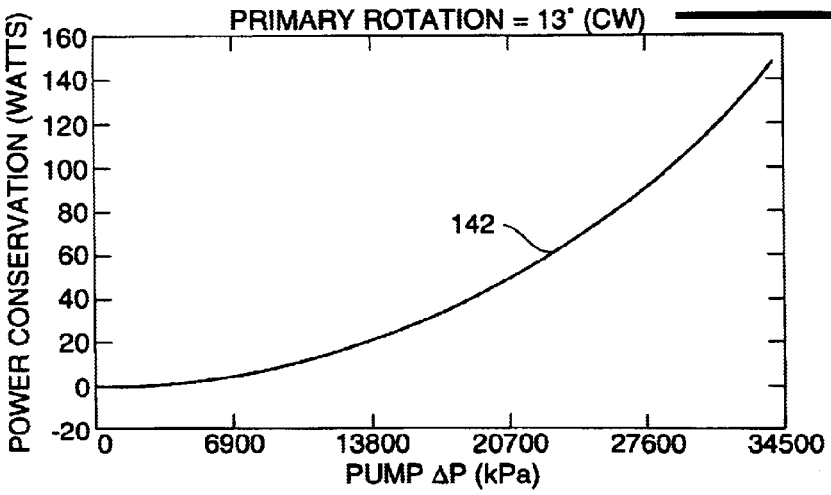

FIGS. 6A–C relates to the same representative working example set forth with respect to FIGS. 4A–C and FIGS. 5A–C. The plots of FIGS. 6A–C illustrate the relationship of power saved with the subject invention when the subject variable displacement axial piston pump 12 is being worked within a range of differential pressures with the primary member 78 being maintained at different fixed angles. The plot line 138 of FIG. 6A illustrates the power savings for a range of differential pressures when the primary member 78 is being maintained at 3 degrees. The plot line 140 of FIG. 6B illustrates the power savings for a range of differential pressures when the primary member 78 is being maintained at 7 degrees while the plot line 142 of FIG. 6C illustrates the power savings for a range of differential pressures when the primary member 78 is being maintained at 13 degrees.

Figure 7A:
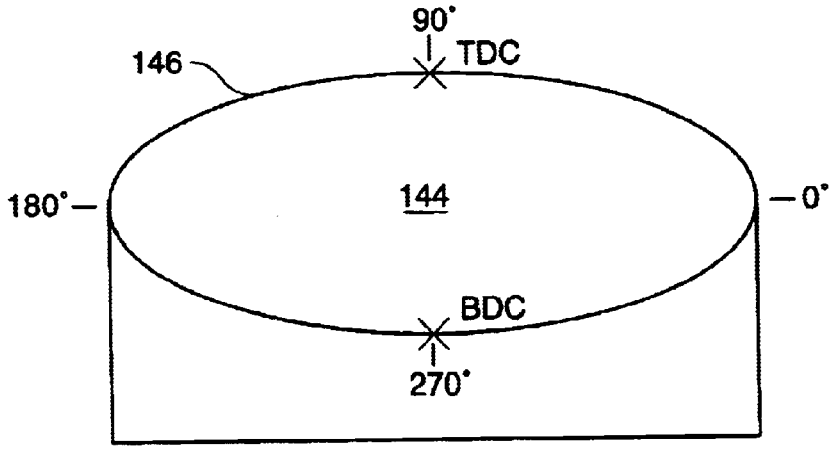
FIGS. 7A–B are plots illustrating how, during operation, the top and bottom dead center positions effectively move when the secondary angle of the swashplate is changed.
Figure 7B:
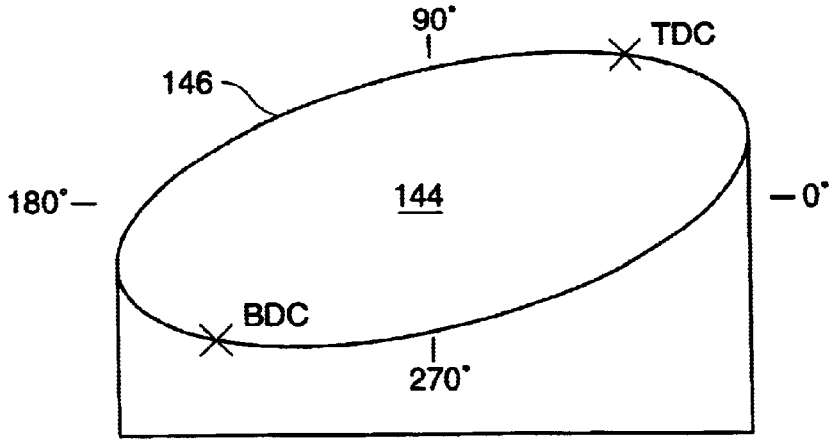

FIGS. 7A–B generally illustrates how the TDC and BDC positions are effectively moved, during use, when the angle of the secondary member 80 is changed relative to the primary member 78. The representative face surface 144 of the plot of FIG. 7A generally illustrates the flat surface 92 of the secondary member 80 with the primary member 78 rotated to its maximum position about its neutral axis, i.e., a line from the "0" degree point to the "180" degree point, with the secondary member 80 at its zero angle position. The outline 146 of the representative face surface 144 illustrates one of the closed cylinder chambers 70 makes a complete revolution. As previously noted, at the "90" degree point, the volume of the closed cylinder chamber 70 is at its smallest volume during the rotation of the barrel 58. As the cylinder chamber 70 rotates counterclockwise from the "90" degree point on to the "270" degree point, the cylinder chamber 70 is increasing in volume and reaches its largest volume at the "270" degree point or BDC position. As it continues to rotate from the "270" degree point to the "90" degree point, the volume in the closed chamber 70 decreases.

FIG. 7B illustrates the representative flat surface 144 with both the primary member 78 and the secondary member 80 angled to their maximum positions. As seen from this representation, the TDC position has shifted from the "90" degree position towards the "0" degree position and the BDC position has shifted from the "270" degree position towards the "180" degree position. Consequently, the respective closed cylinder chambers 70 reach their minimum effective volume at a location less than 90 degrees and each of the closed cylinder chambers 70 reach their maximum effective volume at a location less than 270 degrees of rotation of the barrel 58.

INDUSTRIAL APPLICABILITY

During the operation of the subject fluid system 10 incorporating the subject variable displacement axial piston pump 12, the operator initiates an input to the fluid control valve 20 to direct pressurized fluid to one end of the fluid actuator 26 moving it in the desired direction. The fluid being exhausted from the other end of the fluid actuator 26 returns to the tank 14 across the control valve 20 in a conventional manner. The operator's input results in a simultaneous command, based on the load requirements, being delivered to the operating lever to pivot the primary member 78 to a flow producing angle. In the subject piston pump 12, the angle ranges from 0 degrees to 15 degrees. It is recognized that the magnitude of the angle range could be more or less without departing from the subject invention. An input command to the actuating lever 86 acts to rotate the primary member 78 in a clockwise direction as viewed in FIG. 1. Once the primary member 78 is pivoted to a desired angular position, the respective pistons 64 of the plurality of piston assemblies 62 begin to reciprocate within the respective cylinder bores 59 of the barrel 58. With reference to FIG. 3, a closed chamber 70 is illustrated as being at the TDC position, in which the volume of fluid within the closed chamber 70 is at its smallest level. As the barrel 58 rotates in a counterclockwise direction, the piston 64 begins to withdraw from the cylindrical bore 59 due to the fact that the shoe 66 is following the flat surface 92 of the secondary member 80 that is still at its "0" degree position relative to the primary member 78. Since the flat surface 92 is at an angle with respect to the axis of rotation 60, the distance between the flat surface 92 and the end surface 68 of the barrel 58 is increasing. The movement of the piston 64 results in the volumetric space within the closed chamber 70 increasing. As illustrated in FIG. 3, an arcuate distance is defined in which the closed chamber 70 is not in communication with either the outlet port passage 52 through the slots 74 or with the inlet port passage 50 through the slot 72. Consequently, there is a trapped volume of fluid within the closed chamber 70 that is expanding since the volumetric size of the closed chamber is increasing. Once the closed chamber 70 reaches the slot 72, fluid from the tank 14 begins to enter the closed chamber 70 to fill it with low pressure fluid. It should be recognized that at the TDC position of the closed chamber 70, the fluid within the closed chamber 70 was still pressurized since it had just left communication with the pressurized slots 74. Naturally, the pressurized fluid at TDC is transformed to tank pressure by the time that the closed chamber 70 enters the slot 72. This is referred to as 'the pressure transition'.

Once the closed chamber 70 reaches the BDC position, the closed chamber is totally filled with fluid at tank pressure, which in the subject arrangement is atmospheric pressure. At the BDC position, the closed chamber 70 is at its largest volumetric value. As the rotation of the barrel 58 moves the closed chamber 70 past the BDC position, the piston 64 begins to retracts into the cylinder bore 59 which reduces the volume of the closed chamber 70. From the time the closed chamber 70 leaves the BDC position, the fluid within the closed chamber 70 is trapped from both the tank and the pressure port. During this movement from BDC, the fluid is being compressed. Once the closed chamber 70 reaches the high pressure slots 74, the fluid in the closed chamber 70 enters the slots 74 and forced at the high pressure to the fluid actuator 26 to do work in a conventional manner. From the time that the closed chamber 70 leaves the BDC position, the fluid therein goes from zero pressure to the pressure level within the slots 74 which as noted above is referred to as 'the pressure transition'. As the closed chamber 70 continues to move towards the TDC position, the fluid therein is continually being expelled therefrom at the system operating pressure.

In order to smooth out the respective pressure transitions and improve system operating efficiencies, the volume of trapped fluid at the TDC and BDC positions are controlled. It is believed that the magnitude of fluid compression needed at the TDC and BDC position are very similar. Consequently, the subject invention uses an average of the TDC and BDC fluid compression requirement for both TDC and BDC pressure transition control for each set of system parameters. It should be recognized that the fluid compression requirements change as the system parameters change.

In the subject arrangement, the pressures of the fluid in the tank inlet conduit 16 and the supply conduit 18 are being sensed by pressure sensors 28, 30 and representative signals delivered to the controller 32 to establish a deferential pressure between the inlet port passage 50 and the outlet port passage 52. Likewise, the position of the primary member 78 is being sensed by the position sensor 40 and the representative signal delivered to the controller 32. These system parameters are then being used to determine what position to pivot the secondary member 80. Based on the relationships set forth in the plots illustrated in FIGS. 4A–C and 5A–C, a series of maps would be provided in the controller 32. Consequently, for any differential pressure between the inlet and outlet passages 50, 52 and any angular position of the primary member 78, the controller 32 would generate a signal to move the secondary member 80 to a desired angular position in the range of 0–10 degrees. The secondary member 80 is pivoted, as viewed in FIG. 2, in a counterclockwise direction in response to receipt of the signal from the controller 32 being directed to the remotely controlled actuating mechanism. The output member 122 acts on the force member 124 causing the link 94 to pivot about the pin 102. The link 94 acts on the reaction member 114 to move the secondary member 80 in proportion to the signal from the controller 32.

As clearly indicated in FIG. 7B, any combined movement of both the primary member 78 and the secondary member 80 results in the location of TDC and BDC positions changing from the positions set forth in FIG. 7A that represent angular movement of only the primary member 78. It should be recognized that the representation illustrated in FIG. 7B applies to one example in which both the primary member 78 and the secondary member 80 are at their extreme angular positions. From the illustration of FIG. 7B, it should be noted that the closed chamber 70 reaches the indicated TDC position prior to the barrel 58 reaching the 90 degree position. Consequently, further rotation of the barrel 58 towards the 90 degree position does not change the pressure of the fluid in the closed chamber 70. The pressure within the closed chamber 70 only begins to gradually decrease when the closed chamber 70 reaches the 90 degree position. From a review of FIG. 3 it is noted that the closed chamber 70 is still in communication with the pressure slots 74 at a location less than 90 degrees but due to the change in location of the TDC position, the volume of the closed chamber 70 is at its smallest volume and is slightly increasing as is noted from the outline 146 that represents the path of the piston 64. The volume within the closed chamber 70 is beginning to slightly increase. However, the pressure of the fluid in the fluid system 10 remains the same. As the closed chamber 70 moves from the 90 degree position, communication with the pressure slots 74 is interrupted. As the closed chamber 70 moves through the delta TDC arc, the pressure within the closed chamber 70 is being reduced at a more gradual rate and once it opens into the tank slot 72 the pressure therein has been effectively transformed.

Likewise, once the closed chamber 70, reaches the new BDC position as indicated in FIG. 7B, the volume of the fluid within the closed chamber 70 has reached its largest value. As noted from FIG. 3, the closed chamber 70 is still in communication with the tank through the slot 72. As the closed chamber 70 moves towards the '270' position, the volume of the fluid in the closed chamber 70 is being slightly reduced while it is still in communication with the low pressure slot 72. As the closed chamber 70 moves through the delta BDC arc, the trapped volume of fluid is compressed. Thus the pressure transition between the low pressure slot 72 and the high pressure slots 74 is made smoother by compressing the fluid in the closed chamber 70 while the closed chamber 70 rotates through the trapped region near BDC.

From the above, it is noted that the pressure change within the piston chamber is a function of the volume change that the piston chamber undergoes as the piston passes through the trapped volume region (delta TDC/delta BDC). Naturally, the amount of trap distance required at TDC and BDC will be different for any given angle of the primary member 78 because the amount of fluid in the closed chamber 70 at TDC is less than the amount of fluid in the closed chamber at BDC.

As recognized from a review of FIGS. 6A–C, there is significant power savings of the subject arrangement over conventional systems where the swashplate has only one degree of movement. The plots illustrated are for example only. It is recognized that operation of a different axial piston pump would result in different power savings. Likewise, operation of the subject embodiment would result in different power savings for different angles of the primary member 78.

From the foregoing, it is readily apparent that the subject variable displacement axial piston pump 12 provides smooth pressure transitions between the inlet port passage 50 and the outlet port passage 52 at both TDC and BDC positions. By controlling the pressure transitions, the efficiency of the variable pump is increased.

Other aspects, objects and advantages of the subject invention can be obtained from a study of the drawings, the disclosure and the appended claims.

What is claimed is:

1. A variable displacement axial piston pump adapted for use in a fluid system, comprising:

a housing having a body portion and a head portion with an inlet port passage and an outlet port passage;

a rotating group disposed in the body portion and having an axis of rotation and including a barrel having a plurality of cylinder bores, a plurality of piston assemblies with each of the plurality of piston assemblies having a piston slideably disposed within one of the cylinder bores and a shoe pivotably attached to and extending from the piston, the rotating group being in fluid communication with the inlet and outlet port passages of the housing head portion; and a swashplate arrangement disposed in the body portion and being pivotable in a first arcuate direction relative to the axis of rotation of the barrel and pivotable in a second arcuate direction, the swashplate arrangement being pivotable in the second arcuate direction in response to various system parameters, wherein the swashplate mechanism includes a primary member and a secondary member that is pivotable relative to the primary member.

2. The variable displacement axial piston pump of claim 1 wherein the the primary member is disposed in the body portion and pivots in the first arcuate direction relative to the axis of rotation of the barrel and the secondary member is disposed on the primary member and pivots in the second arcuate direction relative to the primary member.

3. The variable displacement axial piston pump of claim 2 wherein the pivot direction of the primary member is at an angle about the axis of rotation of the rotating group with respect to the pivot direction of the secondary member.

4. The variable displacement axial piston pump of claim 3 wherein the angle between the pivot direction of the primary member and the pivot direction of the secondary member is in the range of 80 to 100 degrees.

5. The variable displacement axial piston pump of claim 3 wherein the variable displacement axial piston pump is a unidirectional pump and the angle between the pivot direction of the primary member and the pivot direction of the secondary member is 90 degrees.

6. The variable displacement axial piston pump of claim 2 including an actuating mechanism disposed between the primary member and the secondary member.

7. The variable displacement axial piston pump of claim 6 wherein the primary member has a spherical surface on one side thereof and the secondary member has a spherical surface on one side thereof that mates with the spherical surface of the primary member.

8. The variable displacement axial piston pump of claim 7 wherein the spherical surface of the primary member is concave in shape and the spherical surface of the secondary member is convex in shape.

9. The variable displacement axial piston pump of claim 8 wherein the secondary member has a flat surface on the opposite side thereof in mating contact with the shoes of the plurality of piston assemblies.

10. The variable displacement axial piston pump of claim 9 wherein the actuating mechanism includes a link having a first portion pivotably disposed within the primary member extending inward from the spherical surface and a second portion in mating contact with the secondary member.

11. The variable displacement axial piston pump of claim 10 wherein the secondary member has a slot defined therein extending inward from the spherical surface thereof and a reaction member disposed in the slot, the second portion of the link extends into the slot and engages the reaction member.

12. The variable displacement axial piston pump of claim 11 including a remotely controlled actuating mechanism having an output member disposed within the primary member in contact with the first portion of the link and operative to move the link in response to an externally controlled force.

13. The variable displacement axial piston pump of claim 11 in combination with a fluid system having a tank, fluid actuator, and a fluid control valve disposed between the fluid actuator and the variable displacement axial piston pump.

14. The variable displacement axial piston pump of claim 2 wherein the various system parameters includes an angular position of the primary member.

15. The variable displacement axial piston pump of claim 14 wherein the various system parameters includes a differential pressure established between the inlet port passage and the outlet port passage.

16. A method of controlling pressure transitions within a variable displacement axial piston pump between its inlet port passage and its outlet port passage, the method comprises:

providing a rotating group having an axis of rotation;

providing a swashplate arrangement pivotable in a first arcuate direction relative to the axis of rotation of the rotating group and pivotable in a second arcuate direction in response to various system parameters, wherein the swashplate mechanism includes a primary member and a secondary member that is pivotable relative to the primary member.

17. The method of claim 16 wherein the primary member is pivotable in the first arcuate direction and the secondary member is pivotable in the second arcuate direction relative to the primary member.

18. The method of claim 17 including the step of positioning the pivot direction of the primary member relative to the pivot direction of the secondary member about the axis of rotation of the rotating group within the range of 80 to 100 degrees.

19. The method of claim 17 including the step of positioning the pivot direction of the primary member relative to the pivot direction of the secondary member about the axis of rotation of the rotating group to 90 degrees.

20. The method of claim 16 including the steps of sensing the position of the primary member and the differential pressure between the inlet port passage and the outlet port passage and providing a remote signal representative of the sensed signals to pivot the swashplate arrangement in the second arcuate direction.

* * * * *